US008525438B1

(12) United States Patent
Cheung et al.

(10) Patent No.: US 8,525,438 B1
(45) Date of Patent: Sep. 3, 2013

(54) LOAD DRIVER WITH INTEGRATED POWER FACTOR CORRECTION

(75) Inventors: Eugene L Cheung, Fremont, CA (US); David J Chen, San Jose, CA (US)

(73) Assignee: Jade Sky Technologies, Inc., San Jose, CA (US)

( * ) Notice: Subject to any disclaimer, the term of this patent is extended or adjusted under 35 U.S.C. 154(b) by 281 days.

(21) Appl. No.: 13/110,724

(22) Filed: May 18, 2011

Related U.S. Application Data

(60) Provisional application No. 61/362,835, filed on Jul. 9, 2010.

(51) Int. Cl.
*H05B 37/02* (2006.01)

(52) U.S. Cl.
USPC ..... 315/291; 315/297; 315/307

(58) Field of Classification Search
USPC ..... 315/291, 294, 297, 307
See application file for complete search history.

(56) References Cited

U.S. PATENT DOCUMENTS

| | | | | |
|---|---|---|---|---|
| 6,486,616 | B1 * | 11/2002 | Liu et al. | 315/291 |
| 2007/0121349 | A1 * | 5/2007 | Mednik et al. | 363/21.01 |
| 2008/0316781 | A1 * | 12/2008 | Liu | 363/80 |
| 2009/0251934 | A1 * | 10/2009 | Shteynberg et al. | 363/81 |
| 2010/0141173 | A1 * | 6/2010 | Negrete | 315/294 |
| 2010/0207536 | A1 * | 8/2010 | Burdalski et al. | 315/224 |
| 2011/0193494 | A1 * | 8/2011 | Gaknoki et al. | 315/297 |

* cited by examiner

*Primary Examiner* — Jason M Crawford
(74) *Attorney, Agent, or Firm* — Edward J. Radlo; Radlo IP Law Group

(57) ABSTRACT

Methods and apparati for forcing the current through a load (11) in a variable DC electrical circuit to be proportional to the input voltage (V(in)). A circuit embodiment of the present invention comprises a source (27) of input AC; a rectifier (23) coupled to the input AC source (27), said rectifier (23) producing a variable DC input voltage; coupled to the rectifier (23), a load (11) having a variable direct current flowing therethrough; and means (12-16) for forcing the current through the load (11) to be proportional to the variable DC input voltage.

5 Claims, 3 Drawing Sheets

LOAD DRIVER WITH INTEGRATED POWER FACTOR CORRECTION

RELATED APPLICATION

This patent application claims the priority benefit of commonly owned U.S. provisional patent application Ser. No. 61/362,835 filed Jul. 9, 2010 entitled "LED Driver With Integrated Power Factor Correction", which provisional patent application is hereby incorporated by reference in its entirety into the present utility patent application.

TECHNICAL FIELD

This invention pertains to the field of driver circuits, such as IC (integrated circuit) drivers, for driving variable DC (direct current) loads, such as LEDs (light emitting diodes).

BACKGROUND ART

The use of high-brightness LEDs in lighting applications is growing rapidly as a result of inherent benefits to LED technology, such as long lifetimes, good efficiency, and use of non-toxic materials. LED lighting solutions, however, still need to offer better performance at better value. Because LEDs prefer to be driven in a more sophisticated fashion as compared to traditional incandescent bulbs, performance is heavily dependent on the LED driver circuit.

Traditional LED driver ICs (integrated circuits) suffer in performance and supported features in several ways. First, the driver efficiency generally falls well short of the desired targets. Similarly, the power factor for existing solutions can be quite poor, especially while in a dimming configuration. Finally, when using the triac-based wall dimmers that are typical in existing installations, conventional solutions may cause annoying flicker while dimming, and are often bulky and unreliable.

When trying to address these concerns, existing solutions can grow substantially in solution complexity, size, and cost, thereby limiting the adoption of such approaches.

The present invention addresses and solves these and other concerns.

DISCLOSURE OF INVENTION

Methods and apparati for forcing the current through a load (11) in a variable DC (direct current) electrical circuit to be proportional to the input voltage (V(in)). A circuit embodiment of the present invention comprises a source (27) of input AC (alternating current); a rectifier (23) coupled to the input AC source (27), said rectifier (23) producing a variable DC input voltage; coupled to the rectifier (23), a load (11) having a variable direct current flowing therethrough; and means (12-16) for forcing the current through the load (11) to be proportional to the variable DC input voltage.

BRIEF DESCRIPTION OF THE DRAWINGS

These and other more detailed and specific objects and features of the present invention are more fully disclosed in the following specification, reference being had to the accompanying drawings, in which.

DETAILED DESCRIPTION OF THE PREFERRED EMBODIMENTS

In a method embodiment of the present invention, an integrated approach to power factor correction is achieved by sampling the rectified line input V(in) from the AC mains 27, and by using that waveform to modulate an on-chip reference 21 used to control the current flowing through the load 11. In this way, the load 11 current is forced to follow the line input voltage V(in) waveform, thereby yielding a good power factor.

Figure 1:
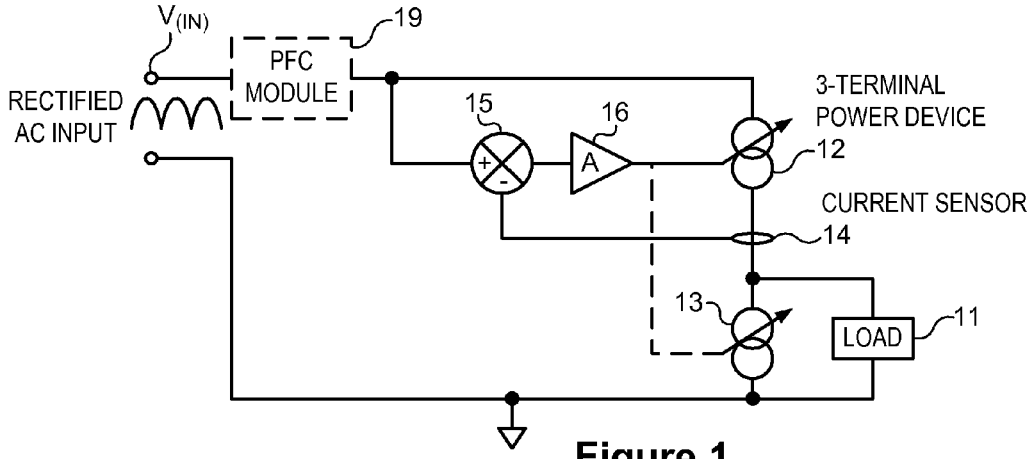
FIG. 1 is circuit diagram of a general embodiment of the present invention.

FIG. 1 shows this method implemented in a general embodiment, in which the modulating step comprises sensing the current flowing through a variable current source 12 that is coupled to the load 11, thereby producing a sensed current signal; and sending the sensed current signal through a feedback loop 15, 16 back to the variable current source 12 to modulate the current flowing through variable current source 12.

Load 11 can be any variable current load, such as any combination of any one or more of the following: a single LED (light emitting diode), any series or parallel combination of LEDs, a capacitor, a motor, a compressor, a refrigerator, an air conditioner, etc. In many applications, load 11 comprises an LED 44 plus a capacitor 45 in parallel with the LED (see FIG. 4).

The embodiment of the present invention that is illustrated in FIG. 1 features a three-terminal variable current source 12 that has two of its terminals respectively coupled to the load 11 and to a rectified AC input voltage V(in). V(in) is graphically illustrated on FIG. 1 as an absolute value of a sine wave. A current sensor 14 senses the current flowing through variable current source 12. A summer 15 having two inputs, a first input coupled to current sensor 14 and a second input coupled to V(in), has its output amplified by post-summing amplifier 16 and fed back to the third terminal of variable current source 12.

In FIG. 1, variable current source 12 is coupled in series with the load 11. In other embodiments, source 12 can be in parallel with load 11, or both in series and in parallel with the load 11. When source 12 is in series with the load 11, there may be a second variable current source 13 that is coupled in parallel with the load 11. Second variable current source 13 may be a two terminal device or a three terminal device. If a three terminal device, its third terminal is coupled to the third terminal of variable current source 12, as illustrated in FIG. 1. The purpose of optional current source 13 is to improve the system efficiency.

This invention eliminates the need for traditional bulky power factor correction (PFC) circuit components (shown within dashed lines as item 19 in FIG. 1), thereby improving the efficiency of the driver circuit, and reducing its size.

Figure 2:
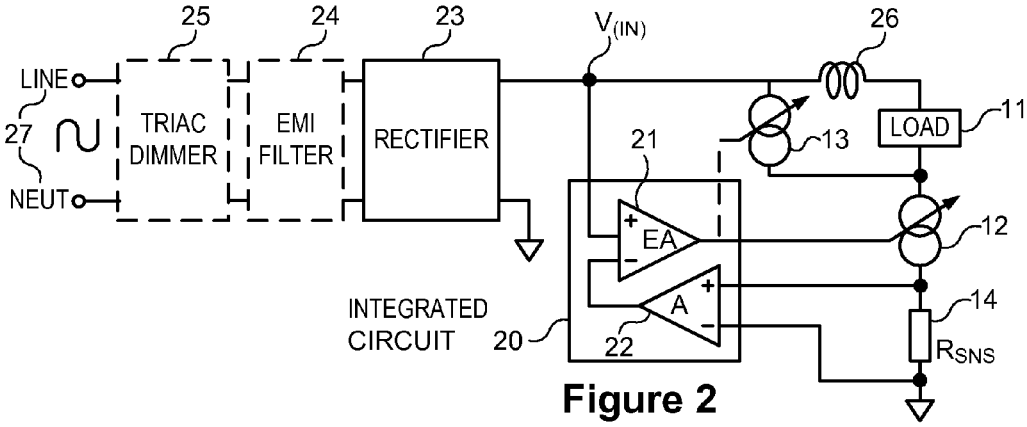
FIG. 2 is a circuit diagram of a non-isolated embodiment of the present invention.

FIG. 2 illustrates a non-isolated embodiment of the present invention, which may be used, for example, for value-conscious lighting solutions in those embodiments where load 11 comprises one or more LEDs. A source 27 of input AC is processed by rectifier 23, producing a variable DC input voltage V(in). Rectifier 23 may be a full bridge rectifier comprising four diodes in a standard bridge configuration. Load 11, which has a variable direct current flowing therethrough, is coupled to bridge rectifier 23 via a power inductor 26. Inductor 26 is particularly useful in smoothing the current that flows through load 11 when current source 12 is a switching power supply.

An EMI (electromagnetic interference) filter 24 is optionally coupled between input AC source 27 and rectifier 23. A triac dimmer 25 may also be optionally coupled between input AC source 27 and rectifier 23. When both EMI filter 24 and triac dimmer 25 are present, triac dimmer 25 is typically placed between input AC source 27 and EMI filter 24.

The remainder of the circuitry illustrated in FIG. 2 is the circuitry that forces the current through the load 11 to be proportional to the variable DC input voltage V(in).

Figure 4:
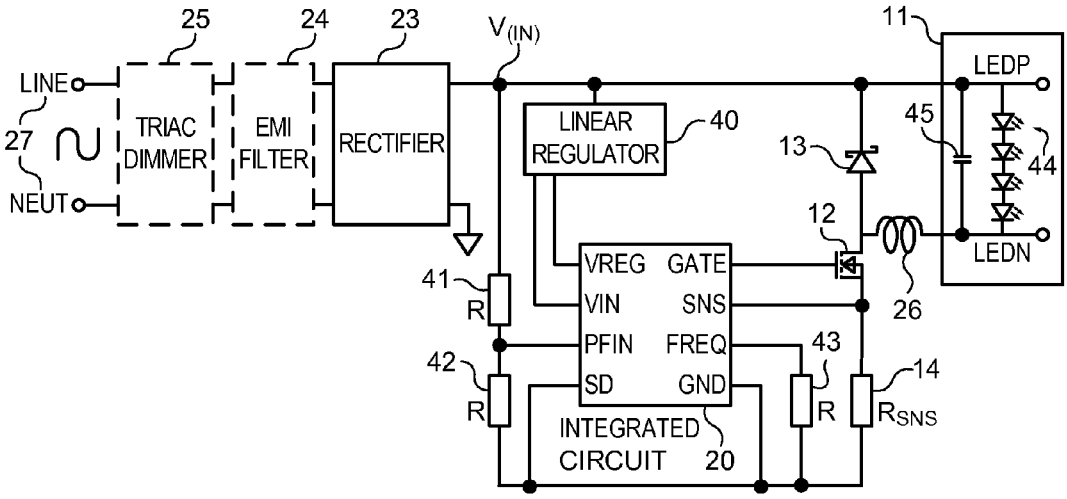
FIG. 4 is a circuit diagram of an embodiment of the present invention in which an integrated circuit 20 is used.

In FIG. 2, current sensing means 14 comprises a resistor 14; and the summer 15 and post-summing amplifier 16 are embodied in a single error amplifier 21. Variable current source 12 may be a switching FET (field effect transistor), as illustrated in FIG. 4. A switching power supply is desirable from the standpoint of efficiency. In general, variable current source 12 can be any power device that can be modulated, such as a three-terminal power device (FET, bipolar transistor, silicon controlled resistor), or a complementary two-terminal power device.

In FIG. 2, a second amplifier 22 is coupled to sensing resistor 14 as shown; and the error amplifier 21 and the second amplifier 22 are embodied within a single integrated circuit 20.

Figure 3:
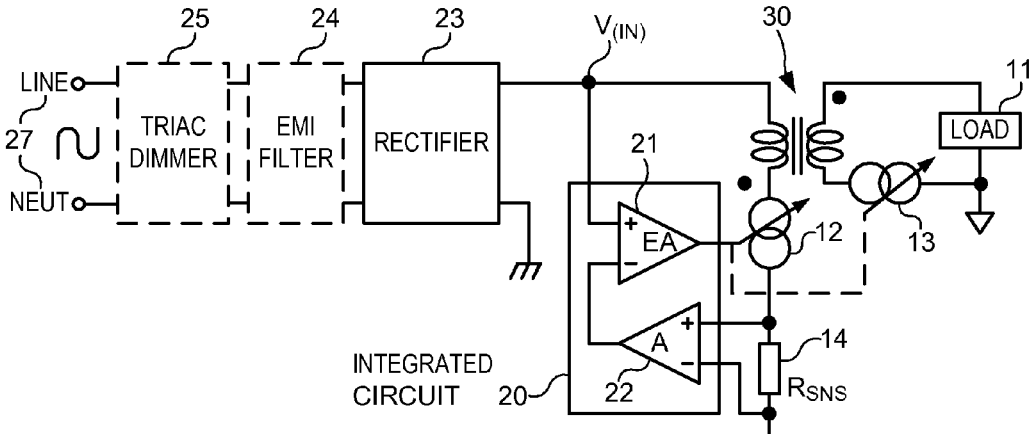
FIG. 3 is a circuit diagram of an isolated embodiment of the present invention.

FIG. 3 illustrates an isolated embodiment of the present invention, in which a transformer 30 takes the place of power inductor 26. The FIG. 3 embodiment is suitable for higher-end performance lighting applications, where electrical isolation is needed or desired, e.g., for reasons of safety. In FIG. 3, three-terminal variable current source 12 is located on the rectifier 23 side of transformer 30, while optional second variable current source 13 is located on the load 11 side of transformer 30.

FIG. 4 illustrates an embodiment of the present invention in which a linear regulator 40 is positioned between rectifier 23 and integrated circuit 20. This can be useful in embodiments where it is desired to more closely control the voltages of the components within integrated circuit 20. In FIG. 4, resistors 41 and 42 constitute a voltage divider, serving to set the input voltage PFIN of IC 20 to a voltage for which IC 20 has been designed. In FIG. 4, variable current source 12 is a switching FET, and second variable current source 13 is a Zener diode. An additional resistor 43 is positioned between the FREQ pin of IC 20 and ground. If a higher level of integration is desired, it is possible to put all of the components of FIG. 4, except for inductor 26 and load 11, into a single integrated circuit 20.

Figure 5:
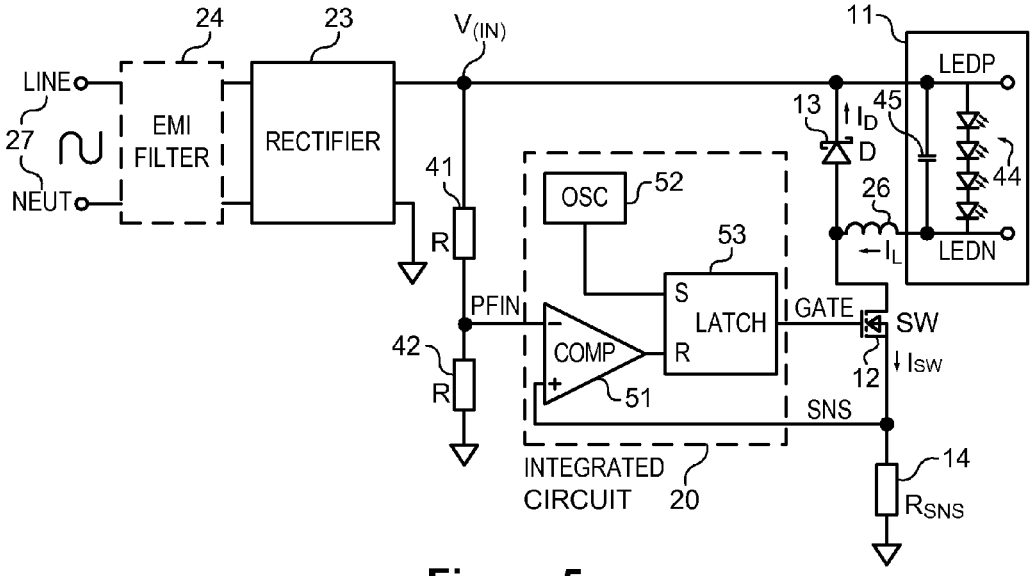
FIG. 5 is a circuit diagram showing components within integrated circuit 20 of FIG. 4.

FIG. 5 illustrates components that are typically encompassed within IC 20: voltage comparator 51, oscillator 52, and latch 53. Comparator 51 has two inputs, a negative input coupled via the PFIN pin of IC 20 to voltage divider 41, 42; and a positive input coupled to current sensing resistor 14 and FET 12 via pin SNS of IC 20. The output of comparator 51 is coupled to the reset input of latch 53. The set input of latch 53 is coupled to the output of oscillator 52, which has an arbitrary frequency of oscillation, e.g., 100 KHz. The output of latch 53 is coupled to the gate of FET 12 via the GATE pin of IC 20.

FIGS. 6*a* through 6*d* are a series of waveforms showing various voltages and currents in the FIG. 5 circuit as a function of a common time t. The FIG. 6*a* waveform shows the voltages V(LEDP) (which is the same as V(in)) and V(PFIN). The latter voltage has the same periodicity, but typically a different amplitude as a function of time, as the former voltage.

Figure 6A:
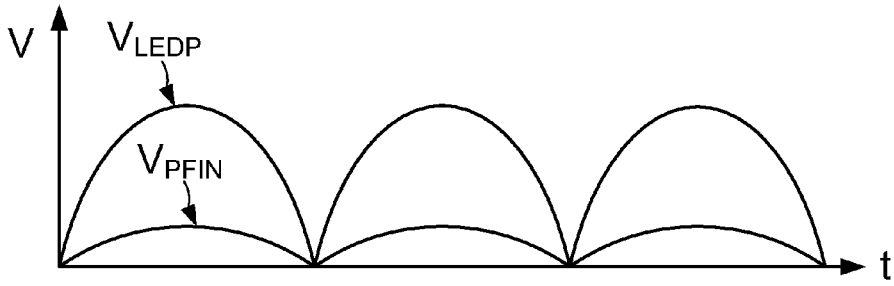
FIGS. 6*a* through 6*d* constitute a set of waveforms showing voltages and currents at various points in the FIG. 5 circuit of the present invention.
Figure 6B:
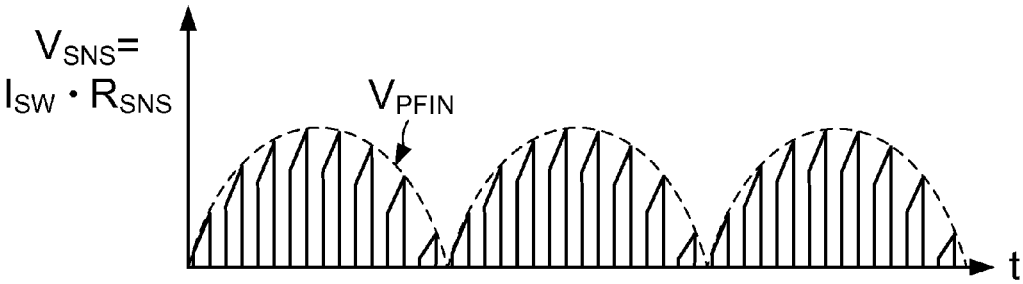

The FIG. 6*b* waveform shows the voltage at the SNS (sense) pin of IC 20. This voltage is equal to the current flowing through switching FET 12 times the resistance of current sensing resistor 14. This voltage has the same envelope as V(PFIN), except it is chopped up at the frequency of oscillation (switching) defined by oscillator 52.

Figure 6C:
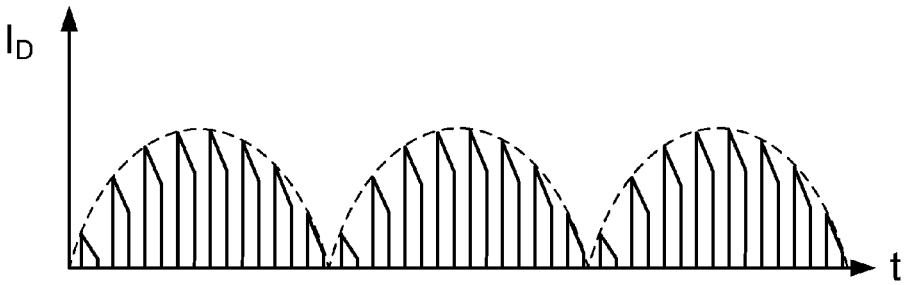

The FIG. 6*c* waveform shows the current flowing through diode 13. This current is chopped at the same frequency as V(SNS), since diode 13 is in series with FET 12, which is switched at the frequency dictated by oscillator 52.

Figure 6D:
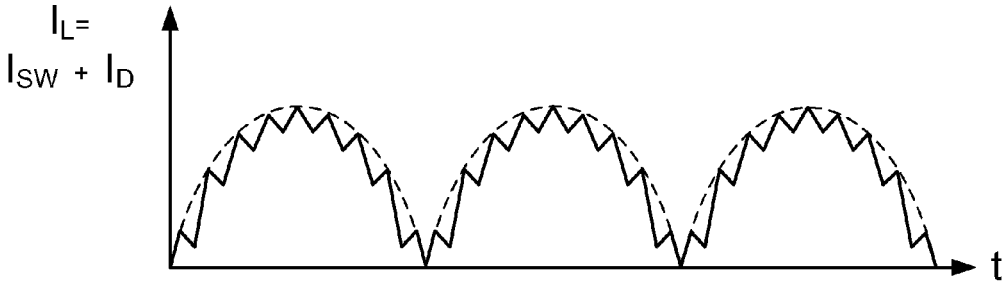

Finally, the FIG. 6*d* waveform shows the current through inductor 26 (and hence the current through load 11), which is equal to the current flowing through FET 12 plus the current flowing through diode 13. Note that this current is proportional to the input voltage V(in) as desired. There is an AC ripple on this load 11 current, at the frequency of oscillation, but this is usually not a problem. The ripple is due to the fact that the power supply 12 is a switching power supply, typically an FET or a variable resistance power supply. For example, when the load 11 comprises an LED or a series of LEDs, the human eye does not notice the ripple because of the eye's innate property of persistence.

The goal of the prior art is to keep a steady current flowing through the load. On the other hand, the goal of the present invention is to make the output current flowing through the load 11 to be proportional to the input voltage V(in), while disregarding AC ripple on the load 11 current when the power supply 12 is a switching power supply.

The present invention exhibits excellent efficiency and power factor, even when a triac dimmer 25 is used.

The above description is included to illustrate the operation of the preferred embodiments, and is not meant to limit the scope of the invention. The scope of the invention is to be limited only by the following claims. From the above discussion, many variations will be apparent to one skilled in the art that would yet be encompassed by the spirit and scope of the present invention.

What is claimed is:

1. A variable DC electrical circuit comprising:

a source of input AC;

a rectifier coupled to the input AC source, said rectifier producing a variable DC input voltage;

coupled to the rectifier, a load having a variable direct current flowing therethrough; and means for forcing the current flowing through the load to be proportional to the variable DC input voltage, wherein the forcing means comprises:

a variable current source coupled to the load and to the rectifier;

coupled to the variable current source, means for sensing current flowing through the variable current source;

coupled to the sensing means and to the rectifier, a summer; and coupled to the summer and to the variable current source, a post-summing amplifier, wherein:

the variable current source is a three terminal device;

the three terminal device is coupled in series with the load; and the circuit further comprises a second variable current source coupled in parallel with the load.

2. The circuit of claim 1 wherein the second variable current source is a three-terminal device.

3. A variable DC electrical circuit comprising:

a source of input AC;

a rectifier coupled to the input AC source, said rectifier producing a variable DC input voltage;

coupled to the rectifier, a load having a variable direct current flowing therethrough; and means for forcing the current flowing through the load to be proportional to the variable DC input voltage, wherein the forcing means comprises:

a variable current source coupled to the load and to the rectifier;

coupled to the variable current source, means for sensing current flowing through the variable current source;

coupled to the sensing means and to the rectifier, a summer; and coupled to the summer and to the variable current source, a post-summing amplifier, wherein:

the variable current source is a three terminal device coupled in series with the load;

the sensing means samples current flowing through the three terminal device, and is coupled to a combination comprising a summer and a post-summing amplifier;

said combination is coupled to a terminal of the three terminal device and to the rectifier; and the circuit further comprises a second variable current source coupled in parallel with the load.

4. A variable DC electrical circuit comprising:

a source of input AC;

a rectifier coupled to the input AC source, said rectifier producing a variable DC input voltage;

coupled to the rectifier, a load having a variable direct current flowing therethrough; and means for forcing the current flowing through the load to be proportional to the variable DC input voltage, wherein the forcing means comprises:

a variable current source coupled to the load and to the rectifier;

coupled to the variable current source, means for sensing current flowing through the variable current source;

coupled to the sensing means and to the rectifier, a summer; and coupled to the summer and to the variable current source, a post-summing amplifier, wherein:

the sensing means comprises a resistor;

a second amplifier is coupled to the resistor;

the summer and the post-summing amplifier are embodied in a single error amplifier, said error amplifier coupled to an output of the second amplifier, to the rectifier, and to the variable current source; and the error amplifier and the second amplifier are embodied within a single integrated circuit.

5. The circuit of claim 4 further comprising a linear regulator coupled to the integrated circuit and to the rectifier.

* * * * *